US011766106B2

(12) United States Patent
Williams

(10) Patent No.: US 11,766,106 B2
(45) Date of Patent: Sep. 26, 2023

(54) LUGGAGE

(71) Applicant: 3 Fold Strategem Limited, Belper (GB)

(72) Inventor: Richard Williams, Belper (GB)

(73) Assignee: ADEPT SUPPLY LIMITED, Ashbourne (GB)

( * ) Notice: Subject to any disclaimer, the term of this patent is extended or adjusted under 35 U.S.C. 154(b) by 0 days.

(21) Appl. No.: 17/637,780

(22) PCT Filed: Sep. 17, 2020

(86) PCT No.: PCT/GB2020/052254
§ 371 (c)(1),
(2) Date: Feb. 23, 2022

(87) PCT Pub. No.: WO2021/053337
PCT Pub. Date: Mar. 25, 2021

(65) Prior Publication Data

US 2022/0279908 A1 Sep. 8, 2022

(30) Foreign Application Priority Data

Sep. 17, 2019 (GB) ..... 1913381

(51) Int. Cl.
*A45C 9/00* (2006.01)
*A45C 5/03* (2006.01)
*A45C 13/00* (2006.01)

(52) U.S. Cl.
CPC ..... *A45C 9/00* (2013.01); *A45C 5/03* (2013.01); *A45C 13/005* (2013.01); *A45C 2005/037* (2013.01); *A45C 2009/005* (2013.01)

(58) Field of Classification Search
CPC ..... A45C 9/00; A45C 5/03; A45C 13/005; A45C 2005/037; A45C 2009/005
See application file for complete search history.

(56) References Cited

U.S. PATENT DOCUMENTS 3,679,223 A * 7/1972 Sakal ..... B62B 7/06 280/37
4,826,196 A 5/1989 Kirkpatrick et al.
5,385,220 A * 1/1995 Pond ..... A45C 13/262 280/37

(Continued)

OTHER PUBLICATIONS

International Search Report dated Nov. 17, 2020 of International Patent Application No. PCT/GB2020/052254 filed Sep. 17, 2020.

(Continued)

*Primary Examiner* — Tri M Mai
(74) *Attorney, Agent, or Firm* — Quarles & Brady LLP; James J. Aquilina

(57) ABSTRACT

A folding wheelchair comprising a luggage compartment, a collapsible frame and wheels, the wheels being mounted to a chassis of the collapsible frame for supporting the folding wheelchair in use, the collapsible frame having a first support pivotally mounted to the chassis at a first end of the first support, the first support and chassis being configured to rotate relative to one another between a stowed position, in which the chassis and the first support are adjacent, and an erect position in which the first support extends away from the chassis to support a seat and handles for pushing the folding wheelchair.

11 Claims, 10 Drawing Sheets

(56) References Cited

U.S. PATENT DOCUMENTS

| | | | | |
|---|---|---|---|---|
| 7,051,853 | B2 * | 5/2006 | Brown | A45C 5/146 280/37 |
| 8,517,398 | B1 * | 8/2013 | Wilson | A45C 5/146 280/37 |
| 8,894,089 | B2 * | 11/2014 | Clifton | B62B 7/08 280/647 |
| 9,357,821 | B1 * | 6/2016 | Montoya | A45C 9/00 |
| 10,966,498 | B1 * | 4/2021 | Quirk | A45C 13/385 |
| 2004/0251717 | A1 | 12/2004 | Tamura | |
| 2008/0164667 | A1 | 7/2008 | Fegler | |
| 2009/0315284 | A1 * | 12/2009 | Osorno | A45C 13/385 280/37 |
| 2012/0161408 | A1 | 6/2012 | Sidhu | |
| 2018/0360183 | A1 * | 12/2018 | Steinkraus | A45C 5/14 |
| 2019/0328093 | A1 * | 10/2019 | Newman | A45C 5/14 |

OTHER PUBLICATIONS

Written Opinion dated Nov. 17, 2020 of International Patent Application No. PCT/GB2020/052254 filed Sep. 17, 2020.

* cited by examiner

LUGGAGE

CROSS-REFERENCE TO RELATED APPLICATIONS

This application is a US National Application of International Patent Application No. PCT/GB2020/052254, filed Sep. 17, 2020, which claims priority to GB Patent Application No. 1913381.8, filed Sep. 17, 2019, all of which are incorporated by reference herein in their entirety for all purposes.

FIELD OF THE INVENTION

In this specification there is described luggage particularly but not exclusively for use when travelling on an aeroplane. The present invention also relates to luggage configurable as a wheelchair.

BACKGROUND OF THE INVENTION

Carry-on hand luggage restrictions imposed by airlines limit the number and size of bags that can be taken on board a flight. This provides challenges for all passengers, but particularly disabled passengers who additionally have assistive devices or mobility equipment to contend with, such as a wheelchair.

When travelling by aeroplane it is common for a wheelchair user to check their wheelchair into the hold due to a number of factors including the size of the wheelchair or particular electrical components integral to the wheelchair. In this scenario it is essential that there is a disability or mobility assistance service to help a passenger to the aeroplane once their wheelchair has been checked in. This service can also assist the passenger to disembark from the aeroplane.

Disability and mobility assistance for a passenger travelling by aeroplane is commonly provided by the arrival and departure airports as opposed to the airline that the passenger is travelling with. This can mean that there is a disparity in the quality and speed of assistance. This disparity depends on the particular airport a passenger is travelling through and the demand at that airport for mobility assistance at any one time.

Both wheelchairs and luggage can be bulky and take up a significant amount of room when travelling by any method, for example when travelling by car. Space in the boot can be valuable and having to transport both a wheelchair and luggage can mean there is often less room for further items which may be desired for the journey.

SUMMARY OF THE INVENTION

The present invention seeks to overcome or alleviate the problems referred to above by providing luggage configurable as a wheelchair, particularly a luggage having dimensions that fall within the mandated allowances of airlines for carry-on hand luggage.

According to the present invention there is provided luggage comprising a rigid shell defining an upper surface to support a person in a seated position thereon, and side surfaces extending from said upper surface, wherein the luggage further comprises a mechanism attached to and surrounding the rigid shell that unfolds so that the rigid shell and the mechanism together form a wheelchair, wherein the mechanism comprises:

a pair of parallel rails fixed to each other in spaced relation, each rail having a front and a rear wheel attached at opposite ends thereof, a pair of lower elongate supports, each lower elongate support having an end mounted to a corresponding rail, each lower elongate support being attached to a corresponding side surface of the rigid shell such that the shell is received between said lower elongate supports, wherein each lower elongate support pivots together with the shell between a stowed position in which each elongate support extends in a direction along the rail to which it is mounted with the shell being received between said parallel rails and with the front and rear wheels depending from each rail positioned alongside a corresponding side surface of said shell, and a deployed position, in which each elongate support extends upwardly from said rail such that the wheels now extend beneath the shell and are positionable in contact with the ground with said upper surface of the shell facing upward to enable a person to sit on said upper surface and be supported by said shell whilst being moved along the ground on said wheels.

The luggage may further comprise a pair of upper elongate supports, an upper elongate support being pivotally mounted to an upper end of a corresponding lower elongate support, and a backrest extending between each upper elongate support, the upper and lower elongate supports being foldable against each other such that the backrest lies against the shell in a stowed position, the upper elongate supports being lockable in an erected position so that a person sitting on the upper support surface can lean on the backrest.

The luggage may further comprise a seat member foldable from a stowed position into a deployed position in which it extends over the upper surface of the shell.

The upper elongate support may be provided with handles for pushing the folding wheelchair.

The shell may be provided with a catch configured to cooperate with a bracket of each rail to secure the shell and pair of lower elongate supports in the deployed position.

Side surfaces of the shell may be separated by front and rear major surfaces, the backrest lying against the rear major surface in the stowed position, and wherein an access flap is provided in a front major surface so that a luggage storing interior of the shell can be accessed irrespective of whether the backrest is in the deployed position or the stowed position.

With the pair of lower elongate supports and the backrest in the stowed positions, the overall dimensions of the luggage may be such to not exceed 60 cm by 50 cm by 30 cm.

Each parallel rail may be telescopically extendable to increase the space between front and rear wheels for improved stability.

The luggage may further comprise a footplate configured to sit flat against the upper surface of the shell when the pair of lower elongate supports is in the stowed position.

Each parallel rail may be provided with a hinge that divides each parallel rail into first and second members, the first and second members being foldable relative to each other about the hinge between deployed and stowed positions, wherein the front wheels are affixed to ends of the first members and the rear wheels are affixed to ends of the second members, and wherein, when the first and second members are in the deployed position, the first and second members extend directly away from each other either side the hinge to position the front and rear wheels for contact with the ground, and wherein, when the first and second members are in the stowed position, each first member extends in a direction along the second member to which it is hinged so that the front and rear wheels are positioned alongside a corresponding side surface of the rigid shell.

A footplate may extend between ends of the first members of the parallel rails so that the footplate is deployed together with the front wheels when the first and second members are in the deployed position.

DETAILED DESCRIPTION

Figure 1:
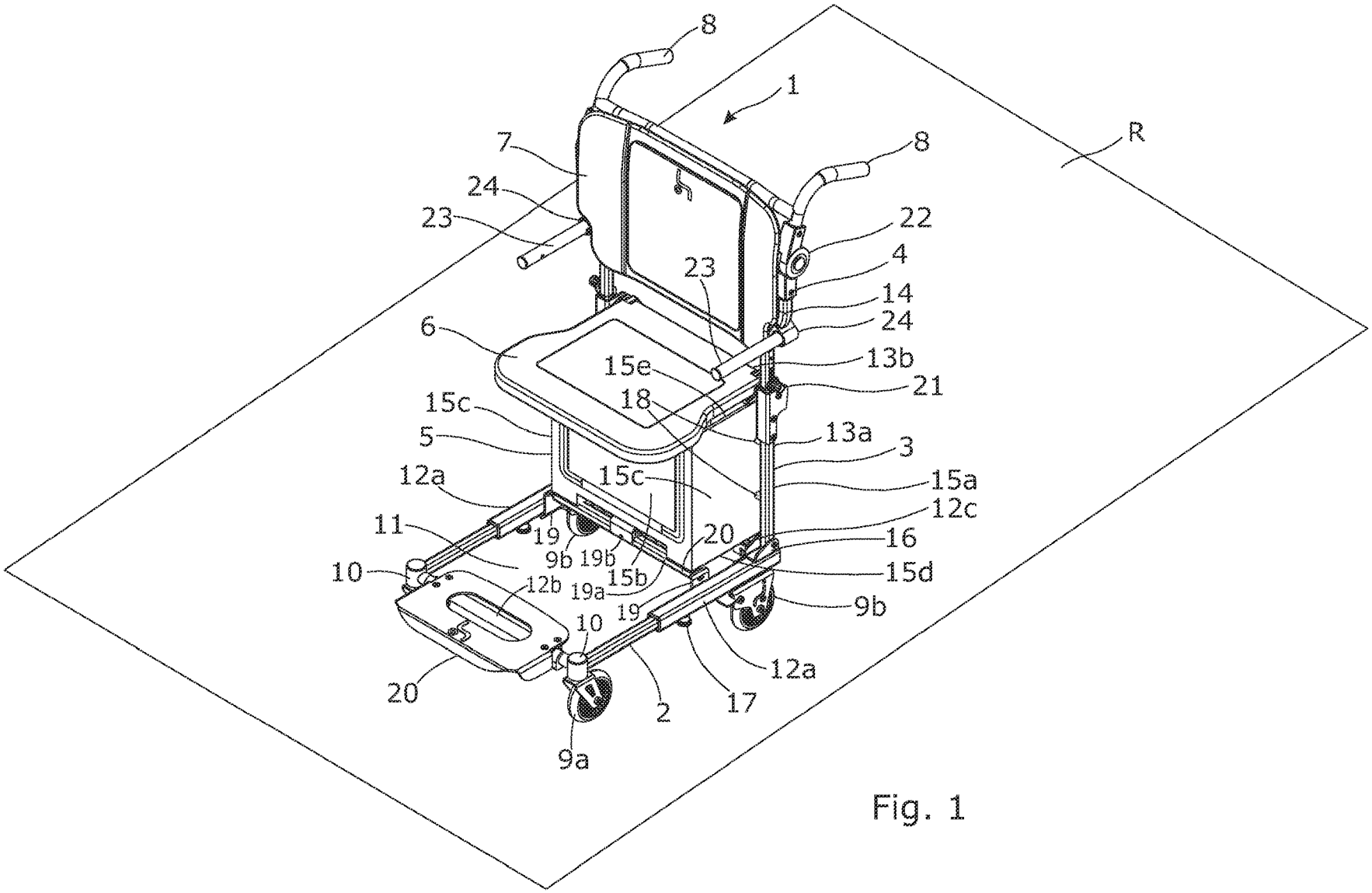
FIG. 1 shows luggage according to the present invention in a wheelchair configuration.
Figure 2:
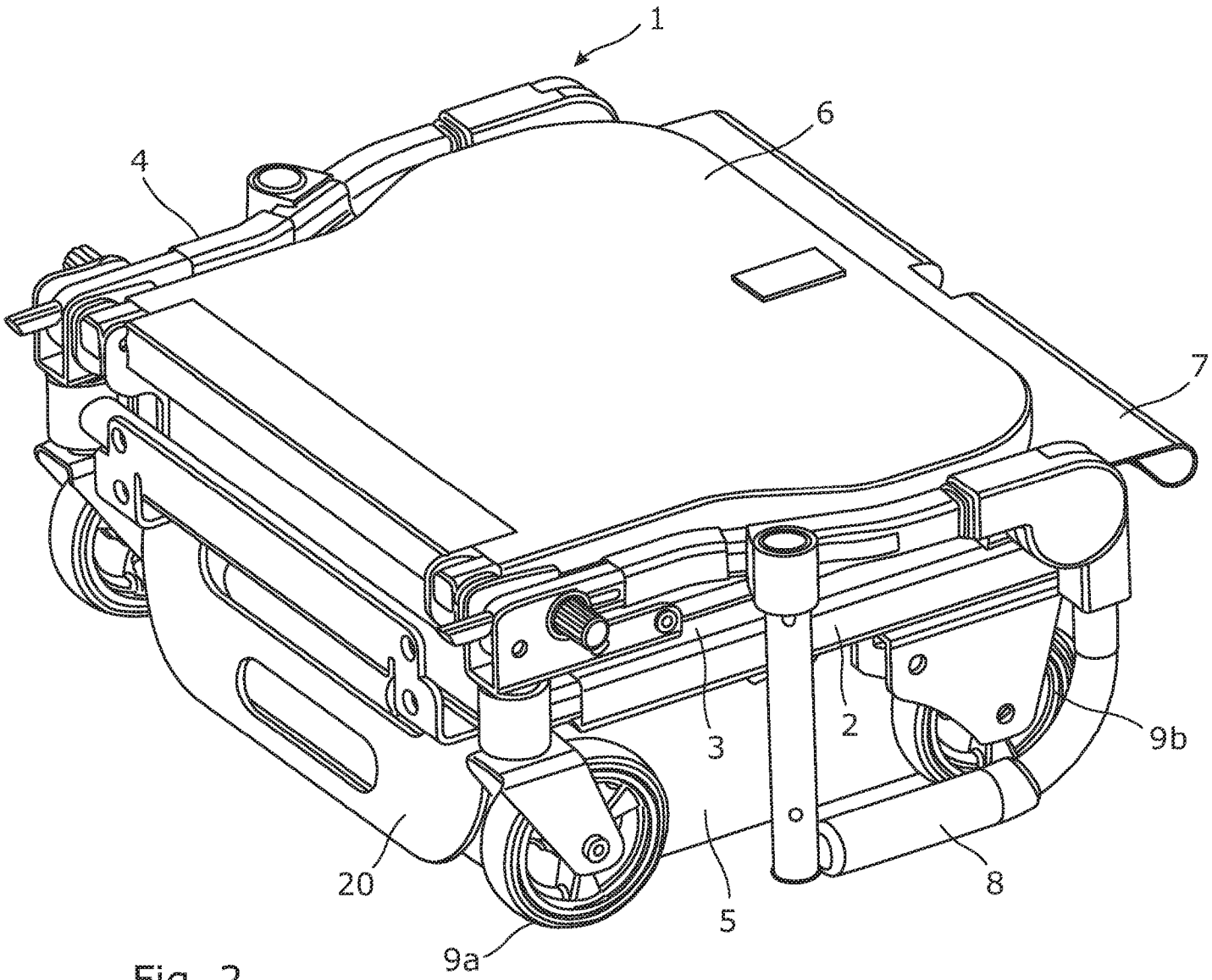
FIG. 2 shows the luggage in a stowed configuration.

FIG. 2 shows luggage 1 according to the present invention that is configurable as a wheelchair. The luggage 1 comprises a rigid shell 5 and a mechanism 2, 3, 4 that surrounds the rigid shell. The mechanism unfolds so that an upper surface 15*e* of the rigid shell 5 is positioned to support a person in a seated position thereon, as shown in FIG. 1.

The mechanism comprises a pair of parallel rails 2 fixed to each other in spaced relation and a pair of lower elongate supports 3. Each parallel rail 2 has a front 9*a* and a rear wheel 9*b* attached at opposite ends thereof. A lower elongate support 3 is pivotably mounted to a rear end of a corresponding rail 2. The lower elongate supports 3 pivot between stowed and deployed positions. The lower elongate supports 3 are attached to side surfaces 15*c* of the rigid shell 5 so that the rigid shell 5 is received between the lower elongate supports 3. Therefore, the lower elongate supports 3 may pivot together with the shell 5 between the stowed and deployed positions. In the stowed position each lower elongate support 3 extends in a direction along the rail 2 to which it is mounted so that the shell 5 is received between the parallel rails 2 and the front and rear wheels 9*a*, 9*b* are positioned adjacent corresponding side surfaces 15*c* of the shell 5. In the deployed position, each lower elongate support 3 extends upwardly from the rail 2 to which it is mounted such that the wheels 9*a*, 9*b* extend beneath the shell 5 and are positionable in contact with the ground. In the deployed position the upper surface 15*e* of the shell 5 faces upward to enable a person to sit on said upper surface 15*e* and be supported by said shell 5 whilst being moved along the ground on said wheels 9*a*, 9*b*.

The mechanism further comprises a pair of upper elongate supports 4. An upper elongate support 4 is pivotally mounted to an upper end of a corresponding lower elongate support 3 and is foldable between a stowed position and an erected position. A backrest 7 extends between each upper elongate support 4. The upper and lower elongate supports 4, 3 are foldable against each other such that the backrest lies against the shell 5 in the stowed position. The upper elongate supports 4 are lockable in the erected position so that a person sitting on the upper support surface 15*e* can lean on the backrest 7.

A seat member 6 co-pivots with the upper elongate supports between a stowed position and a deployed position. In the deployed position, the seat member 6 rests on, and is supported, by the upper surface 15*e* of the shell 5. The seat member 6 provides a padded surface for a person seated thereon.

Handles 8 are provided at an upper end of each upper elongate support 4 for maneuvering the luggage 1 when the luggage 1 is configured as a wheelchair.

With the lower and upper elongate supports 3, 4 in the stowed position, the luggage 1 is provided in the stowed state, as shown in FIG. 2. It is an object of the invention to provide luggage 1 configurable as a wheelchair 1 that, in the stowed state, has dimensions that do not exceed 60 cm by 50 cm by 30 cm. More preferably these dimensions do not exceed 56 cm by 45 cm by 25 cm. Yet more preferably, these dimensions do not exceed 55 cm by 35 cm by 20 CM. Therefore, in the stowed state, the luggage 1 is within the cabin luggage allowance of most airlines.

In the stowed position the lower elongate supports 3 are folded adjacent corresponding rails 2 and the upper elongate supports 4 are folded adjacent corresponding lower elongate supports 3 so that the lower elongates supports 3 lie between corresponding rails 2 and corresponding upper elongate supports 4.

Advantageously the rails 2 outline a space ii for receiving the shell 5 in the stowed position. Therefore, the shell 5 is disposed between the rails 2 in the stowed position for space efficiency.

The rails 2 are fixed to each other by perpendicularly extending axle members 12*b*, 12C which are fixed to the rails at front and rear ends of the rails 2 to define a four sided frame. The wheels 9*a*, 9*b* are fixed at each corner of the frame for supporting the luggage 1 in the wheelchair configuration. The front wheels 9*a* are provided on casters 10 to allow rotation of each of the front wheels 9*a* about a steering axis so that the luggage 1 in the wheelchair configuration can be steered. The rear wheels 9*b* are provided in a fixed orientation in which they are aligned to a forward direction of the luggage 1 in the wheelchair configuration. However, it will be appreciated that the rear wheels 9*b* may also be provided on casters if preferred.

The rails 2 are configured to telescopically extend from a stowed position to an extended position to increase the distance between the front and rear wheels 9*a*, 9*b*. This improves stability of the luggage 1 in the wheelchair 1 configuration. A locking mechanism 17 is provided to lock the rails 2 in one of the extended and stowed positions. The locking mechanism 17 may comprise a spring loaded catch or similar. The skilled person will appreciate that any appropriate locking mechanism can be used.

A foot plate 20 is provided on the front axle member 12*b* and configured to pivot around the front axle member 12*b* between a stowed position and a deployed position.

The lower pair of elongate supports 3 are connected by a connecting member 13*b* to define a U shaped, three sided frame. Hinges 16 are provided to attach each lower elongate support 3 to a rail 2. Each hinge 16 comprises a bracket 16 fixed to a rear end of the rails 2. Lower elongate supports 3 are pivotally mounted to the brackets 16 for rotation between the deployed position, in which the pair of lower elongate supports 3 extend perpendicular to the rails 2, and the stowed position in which the lower elongate supports 3 and rails 2 are adjacent.

The rigid shell 5 is a parallelepiped comprising first and second major surfaces 15*a*, 15*b* that separate side surfaces 15*c*. The lower elongate supports 3 extend either side the rigid shell 5 adjacent side surfaces 15*c*. The cross member 13*b* extends adjacent upper surface 15*e*. In this way, the major surfaces 15*a*, 15*b* of the rigid shell 5 are unobstructed by the lower elongate supports 3 or the cross member 13*b* so that a luggage storing interior of the rigid shell can be accessed through major surface 15*b*.

The lower elongate supports 3 are attached to the rigid shell 5 by tie bars 18 which extend between the lower elongate supports 3 and respective side panels 15*c*.

When the rigid shell 5 is in the stowed position, the rigid shell 5 is received between the rails 2 so that the rails 2 are adjacent the minor surfaces 15*c*, as shown in FIG. 2. Axle members 12*b* extend adjacent the upper and lower surfaces 15*e*, 15*d* of the rigid shell 5. Therefore the major surface 15*b* remains unobstructed so that the luggage storing interior of 5 of the shell 5 is accessible irrespective of whether the shell 5 is in the deployed or stowed position.

The relative positions of the shell 5 will now be defined with reference to a reference plane R. Said reference plane R is defined by the rails 2 and axle members 12*b*, 12C. In other words, each of the rails 2 and axle members 12*b*, 12C lie within the reference plane R. It will be appreciated that the reference plane R is parallel to the ground when the luggage in the wheelchair configuration is stood on all four wheels 9*a*, 9*b*.

When the lower elongate members 3 are in the stowed position, the major surfaces 15*a*, 15*b* of the shell 5 are parallel to the reference plane R; and when the lower elongate members 3 are in the deployed position the major panels 15*a*, 15*b* of the shell 5 are perpendicular to the reference plane R.

The seat member 6 is a cushioned panel hingedly attached along a rear edge to the cross member 13*b* for rotation between the stowed and deployed positions. In the stowed position, the seat member 6 lies flat against the backrest 7, as shown in FIG. 2.

With the lower elongate supports 3 in the deployed position, the shell 5 is disposed to 3*o* support the seat member 6, as shown in FIG. 1. In particular, the seat member 6 can be rotated about the cross member 13*b* away from its stowed position against the backrest 7 and onto an upper surface 15*e* of the rigid shell 5. It will therefore be appreciated that the rigid shell 5 must be of a sturdy construction so that a person seated thereon is reliably supported. With the seat member 6 on the upper surface 15*e* of the rigid shell 5, the seat member 6 is disposed parallel to the reference plane R.

A locking mechanism is provided to lock the lower elongate supports 3 in the deployed position. The locking mechanism comprises a bracket 19 on each of the rails 2 disposed to cooperate with a latch 19*a* extending from each of the side surfaces 15*c* of the rigid shell 5. Therefore, when the lower elongate supports 3 are moved into the deployed position, the latch 19*a* engages the brackets 19 to lock the lower elongate supports 3 and rigid shell 5 in the deployed position. In the illustrated embodiment, the latch 19*a* comprises bar 19*a* mounted to the lower surface 15*d* of the shell 5. Ends of the bar 19*a* are provided with a sprung bolt (not shown) for engaging the brackets 19 to lock the lower elongate supports 3 in the deployed position. A release handle 19*b* is housed by the bar 19*a* and, in use, is configured to retract the bolts, decoupling the bolts from respective brackets 19. This unlocks the lower elongate supports 3 for movement between the deployed and stowed positions.

The backrest 7 folds together with the upper elongate supports 4 between the stowed and erected positions. With the upper and lower elongate supports 3, 4 in the erected position, the backrest 7 is perpendicular to the reference plane R.

Each upper elongate support 4 is mounted to the upper end of a respective lower elongate support 3 by a bracket 21. The bracket 21 hingedly attaches the upper elongate supports so that they fold relative to the lower elongate supports between the stowed and erected positions. The bracket 21 may include a locking mechanism (not shown) to lock the upper elongate supports 4 in either of the stowed or erected positions.

The handles 8 are hingedly connected by brackets 22 to the upper ends of respective upper elongate supports 4 to allow rotation relative to the upper elongate supports 4 between stowed and deployed positions. Each bracket 22 may be provided with a locking mechanism (not shown) to lock the handles 8 in one of the stowed and deployed positions.

With the luggage 1 in the stowed state as shown in FIG. 2, the handles 8 are positioned alongside a corresponding side surface 15*c* of the shell 5, outwardly of wheels 9*b*, so that each wheel 9*b* lies between a handle 8 and a corresponding side surface 15*c*. The handles 8 remain within the desired overall dimensions of the luggage 1 in the stowed state.

Each of the upper elongate supports 4 are provided with armrests 23. Each armrest 23 extends from an upper elongate support 4, either side of the back restraint 7.

The armrests 23 are movable between stowed and deployed positions. To achieve this, the armrests 23 are rod shaped and slide through a tube shaped bracket 24 mounted to each upper elongate support 4. The armrests 23 may be provided with a spring loaded catch (not shown) to secure the armrests 23 in one of the stowed and deployed positions. For example a ball and socket type catch can be used, wherein the ball is resiliently mounted in each armrest for cooperation with a respective socket in an internal wall the tube shaped brackets 24. The skilled person will appreciate however that other suitable catches can be used.

So that the armrests 23 remain within the desired overall dimensions of the luggage 1 in the stowed state, the armrests 23 are disposed adjacent side panels 15*c* of the luggage compartment in their stowed position, as shown in FIG. 2.

The process of converting the luggage from the stowed configuration to the wheelchair configuration will now be explained with reference to FIGS. 3*a* to 3*g*.

Figure 3A:
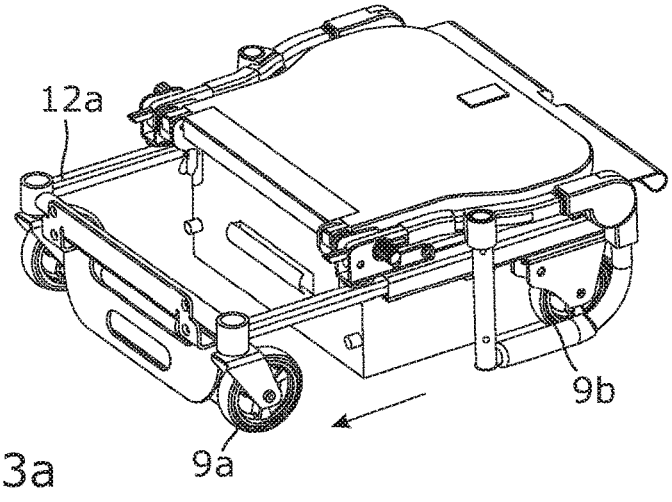
FIGS. 3*a* to 3*g* show the luggage in various stages of transformation between the stowed and wheelchair configurations.
Figure 3B:
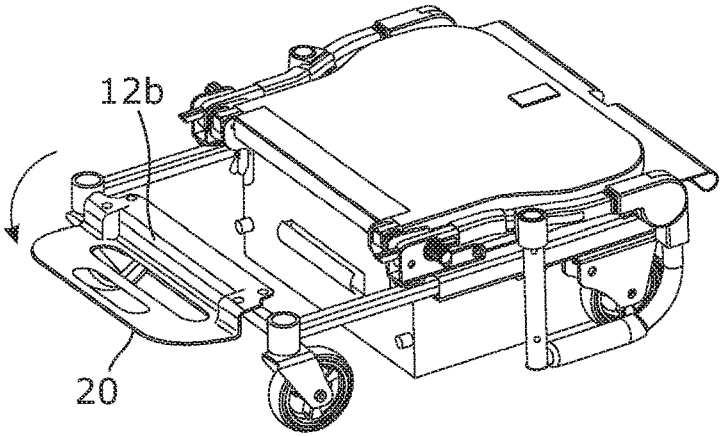
Figure 3C:
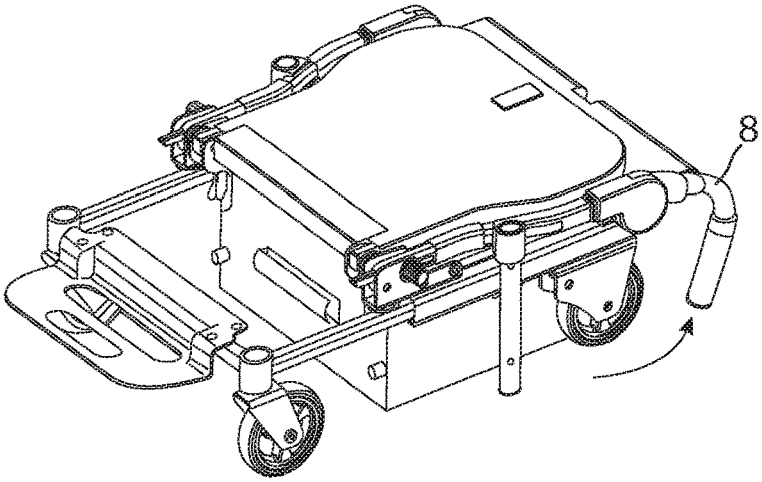

Initially, as illustrated by FIG. 3*a*, the front 9*a* and rear 9*b* wheels are further separated by telescopic extension of the rails 2. The foot plate 20 can then be rotated about the front axle member 12*b* into its deployed position, as shown in FIG. 3*b*. Following this, the handles 8 are moved into the deployed position as shown in FIG. 3*c*.

Figure 3E:
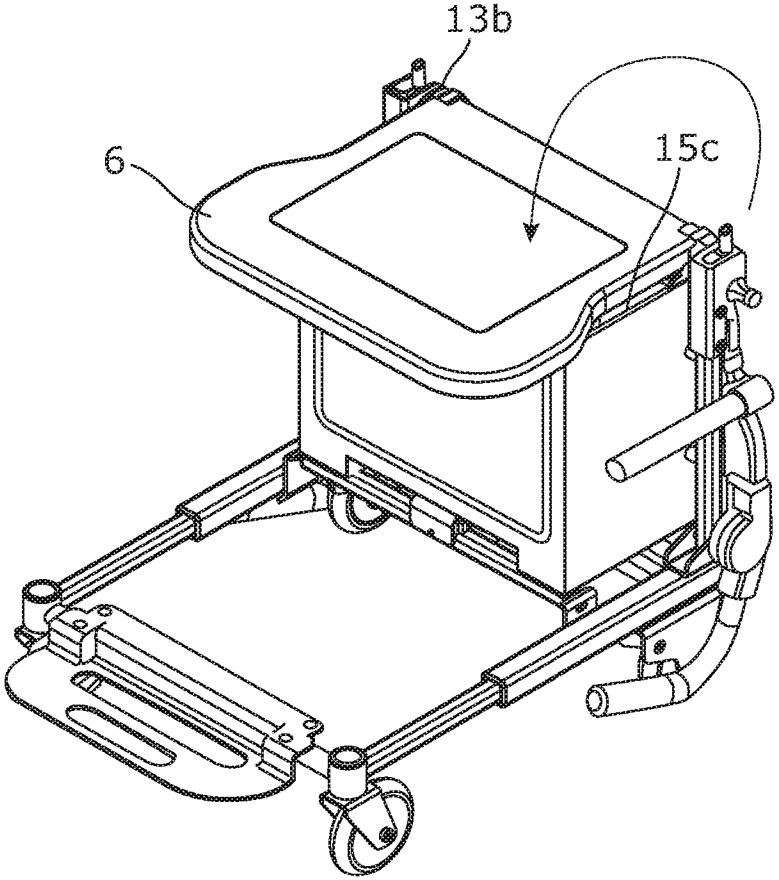
Figure 3D:
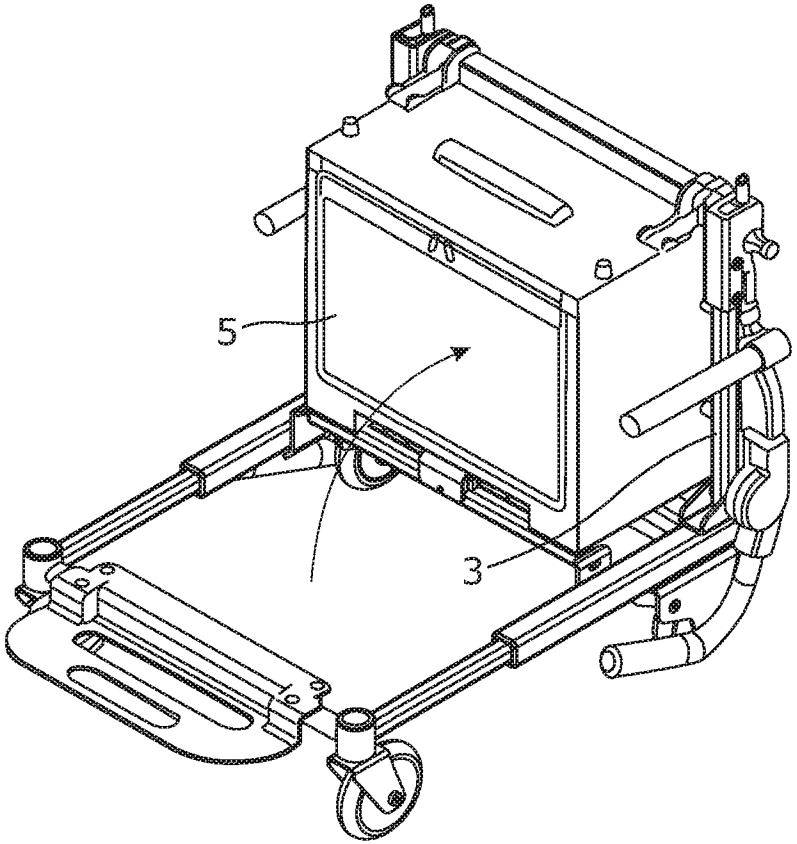

The lower elongate supports 3 are then moved together with the shell 5 into the deployed position so that wheels 9*a*, 9*b* extend beneath the shell 5 and are positionable in contact with the ground, as shown in FIG. 3*d*.

The seat member 6 is folded about the cross member 13*b* to lie on the upper surface 15*e* of the rigid shell 5, as shown in FIG. 3*e*.

Figure 3G:
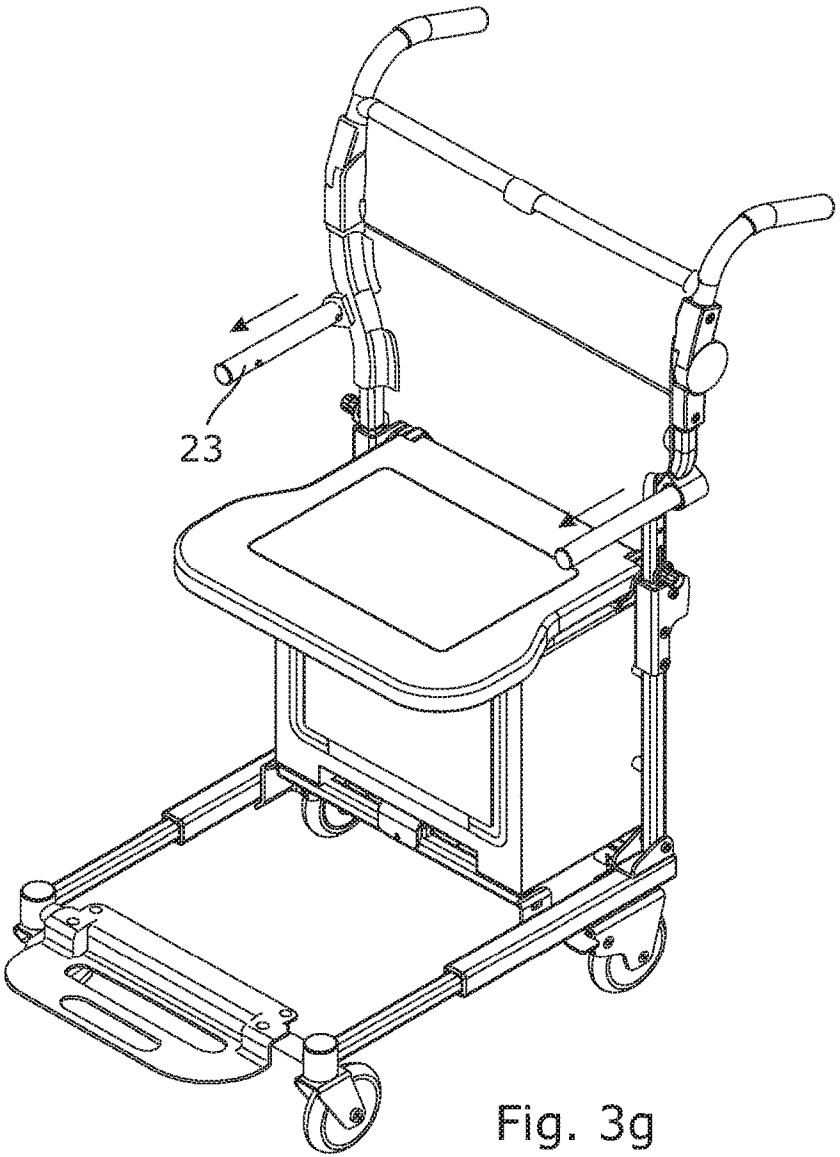
Figure 3F:
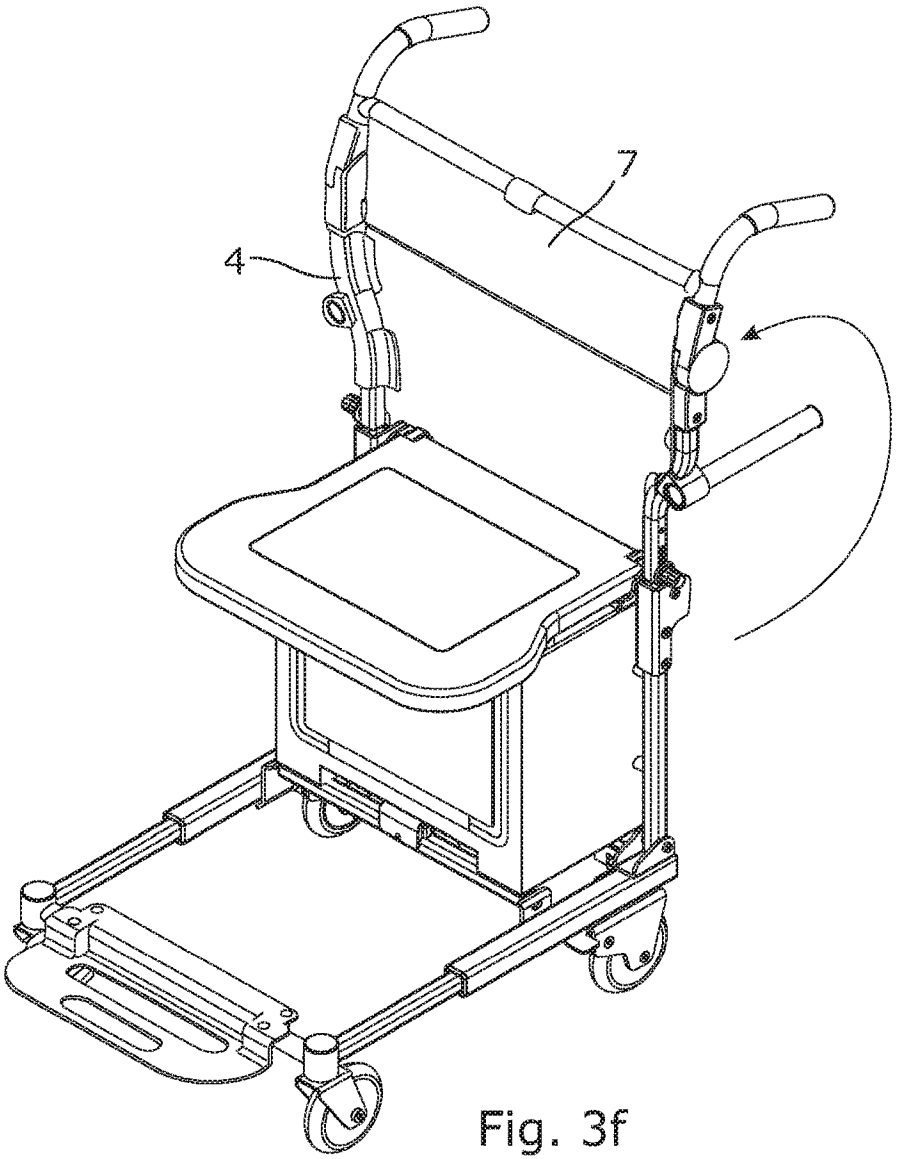

The upper elongate supports 4 are then moved into the erected position to establish the backrest 7, as shown in FIG. 3*f*.

Finally, the armrests 23 are pushed out over the seat member 6 to establish the wheelchair configuration, as shown in FIG. 3*g*.

Another embodiment of the invention—in which like features retain the same reference numbers—is shown in FIGS. 4 to 6*g*. The principle differences between the embodiment of FIGS. 4 to 6*g* and the above described embodiment of FIGS. 1 to 3*g* are set out below. It will be appreciated that, aside from these differences, both embodiments share like features which do not need to be described again in detail.

Figure 4:
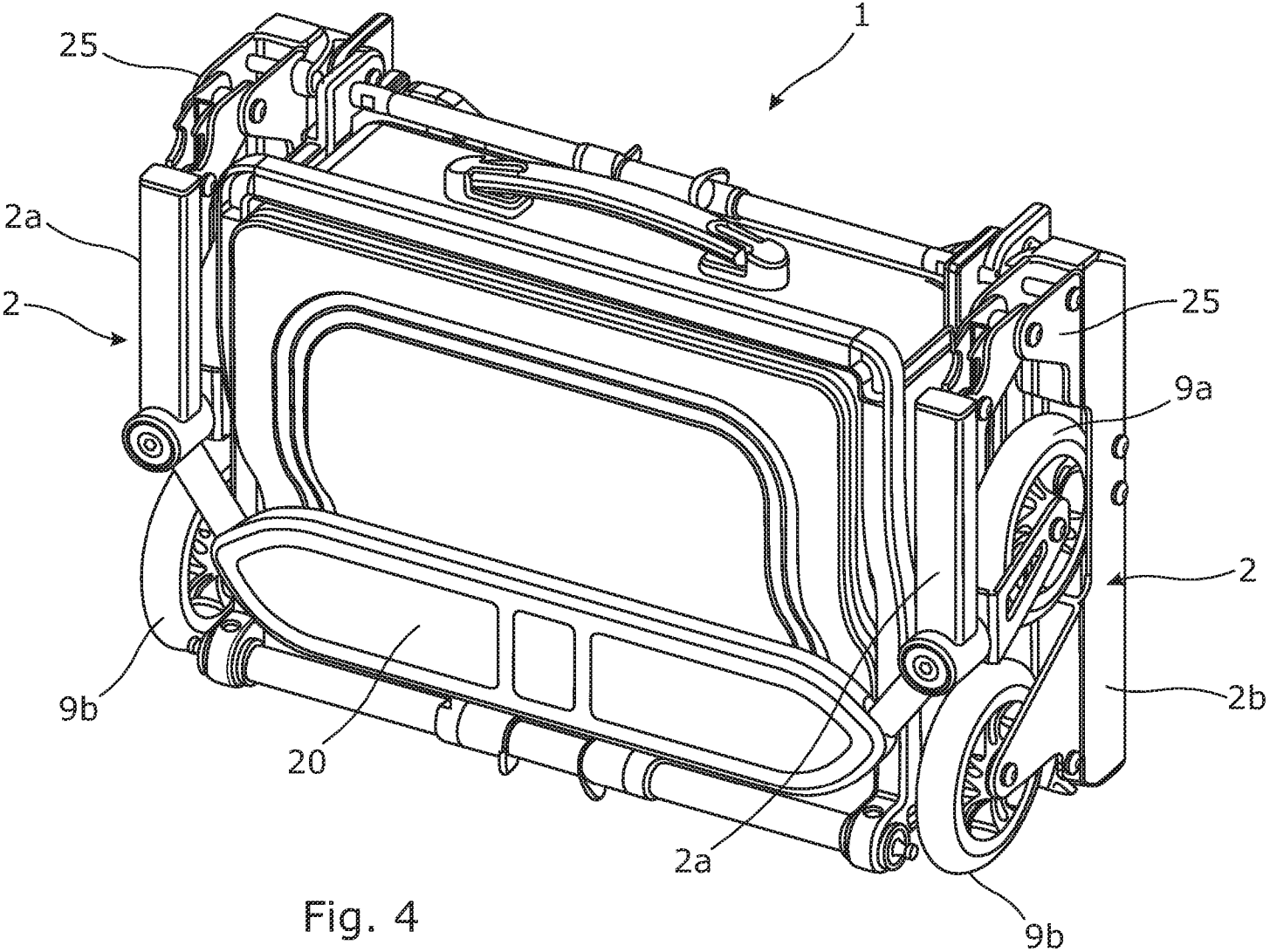
FIG. 4 shows luggage according to another embodiment of the invention in a wheelchair configuration.
Figure 5:
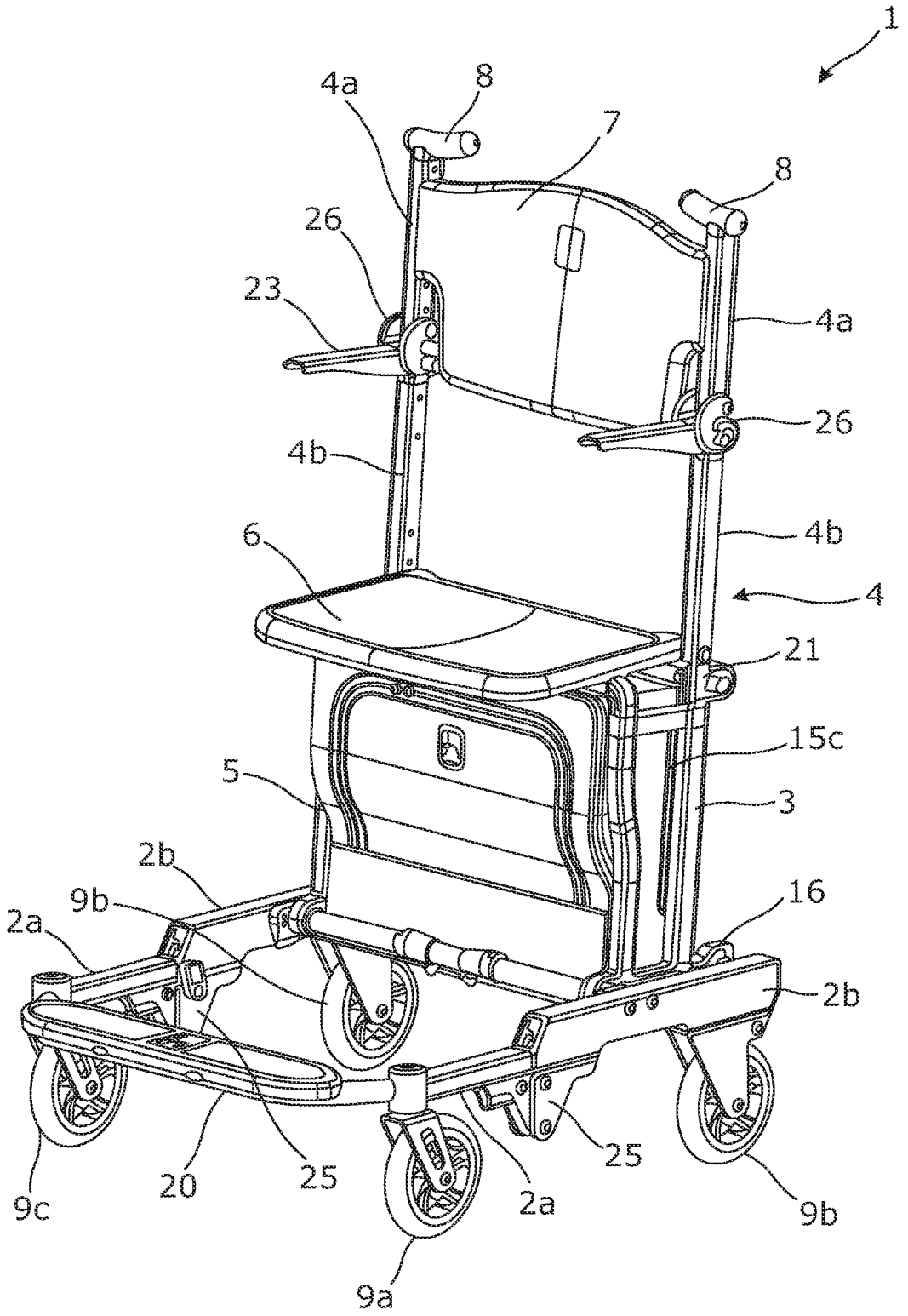
FIG. 5 shows the luggage of FIG. 4 in a stowed configuration.

With reference to FIGS. 4 to 5, each parallel rail 2 is divided into first and second members 2*a*, 2*b* by a hinge 25. The first and second members 2*a*, 2*b* are foldable relative to each other about the hinge 25 between deployed and stowed positions. The front wheels 9*a* are affixed to ends of the first members 2*a* and the rear wheels 9*b* are affixed to ends of the second members 2*b*, so that, when the first and second members 2*a*, 2*b* are in the deployed position (as shown in FIG. 5), the first and second members 2*a*, 2*b* extend directly away from each other either side the hinge 25 to position the front and rear wheels 9*a*, 9*b* for contact with the ground. When the first and second members 2*a*, 2*b* are in the stowed position (as shown in FIG. 4), each first member extends 2*a* in a direction along the second member 2*b* to which it is hinged so that the front and rear wheels 9*a*, 9*b* are positioned alongside a corresponding side surface 15*c* of the rigid shell 5.

The hinge 25 has an axis of rotation that is offset from a longitudinal axis of the first and second members 2*a*, 2*b* so that the first and second members 2*a*, ab are spaced apart in the stowed position, leaving a space for the front wheels 9*a*, 9*b* to nest between the first and second members 2*a*, 2*b*. The offset axis of the hinge 25 also means that ends of the first and second members 2*a*, 2*b* attached to the hinge 25 are configured to abut when in the deployed position, preventing over rotation of the first and second members 2*a*, 2*b* and providing a stable base. The hinge 25 may also comprise a releasable locking mechanism to allow the first and members 2*a*, 2*b* to lock into the deployed position for additional safety.

The footplate 20 extends between the first members 2*a* so that the footplate 20 is deployed together with the front wheels 9*a* when the first and second members 2*a*, 2*b* are in the deployed position.

The upper elongate supports 4 are further split into upper and lower members 4*a*, 4*b* by a hinge 26 that enables the upper elongate supports 4 to fold in two, between erected and stowed positions. In particular, in the erected position, the upper and lower members 4*a*, 4*b* extend directly away from each other either side the hinge 26 and lock in place, so that each upper elongate support 4 extends as a single continuous member. The back rest 7 extends between the upper members 4*a* of the upper elongate supports 4, while the handles 8 are provided directly on the ends of the upper members 4*a* so that the handles 8 and the back rest 7 are deployed simultaneously with the upper member 4*a*. The hinges 26 conveniently provide fixing points for the armrests 23, which rotate about the same axis as the upper members 4*a* into a deployed position in which they extend perpendicularly from the upper elongate support 4. To stow the upper elongate supports 4 and the arm rests 23 in the stowed position, each upper member 4*a* and arm rest 23 folds together against the lower member 4*b* so that upper member 4*a* and the arm rest 23 extend in a direction along the lower member 4*b*. The lower member 4*b* then folds together with the upper member 4*a* and the arm rest 23 against the lower elongate support 3 so that the lower member 4*b* extends in a direction along the lower elongate support 3. Therefore, each of upper and lower members 4*a*, 4*b*, the arm rests 23 and the lower elongate supports 3 pack down adjacent to each other, with the upper members 4*a* and the arm rests 23 being sandwiched between the lower members 4*b* and the lower elongate supports 3.

Figure 6A:
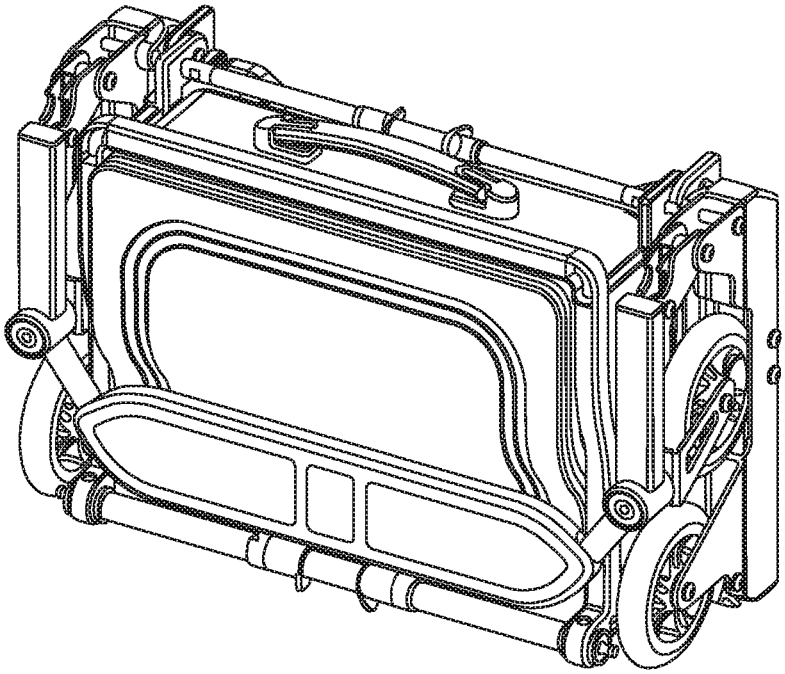
FIGS. 6*a* to 6*g* show the luggage of FIG. 4 in various stages of transformation between the stowed and wheelchair configurations.
Figure 6B:
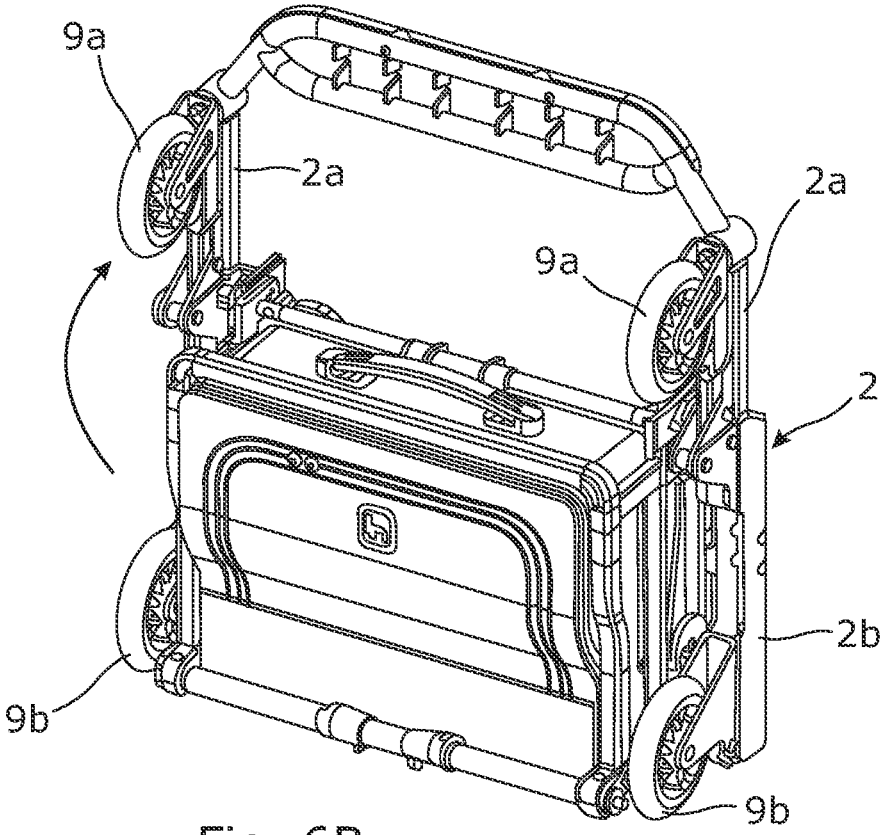

The process of converting the luggage of the present embodiment from the stowed configuration (as shown in FIG. 6*a*) to the wheelchair configuration (as shown in FIG. 6*b*) will now be explained with reference to FIGS. 6*a* to 6*g*.

Initially, as illustrated by FIG. 6*b*, the front and rear wheels 9*a*, 9*b* are separated by unfolding the first and second members 2*a*, 2*b* of the parallel rails 2 into the deployed position.

Figure 6D:
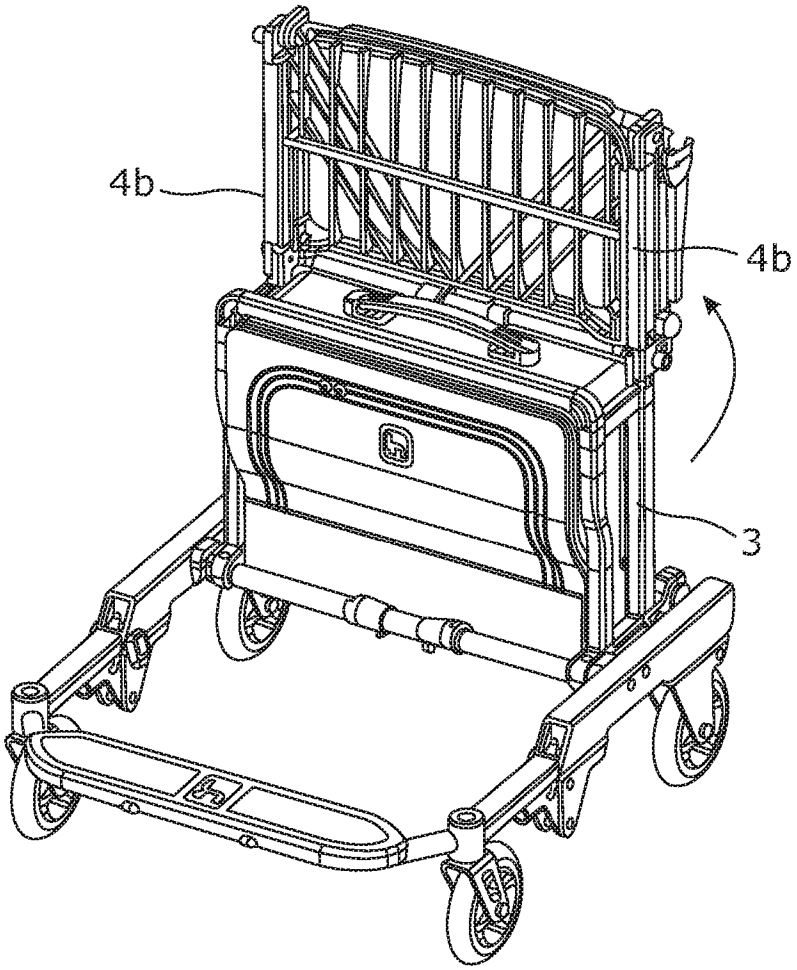
Figure 6C:
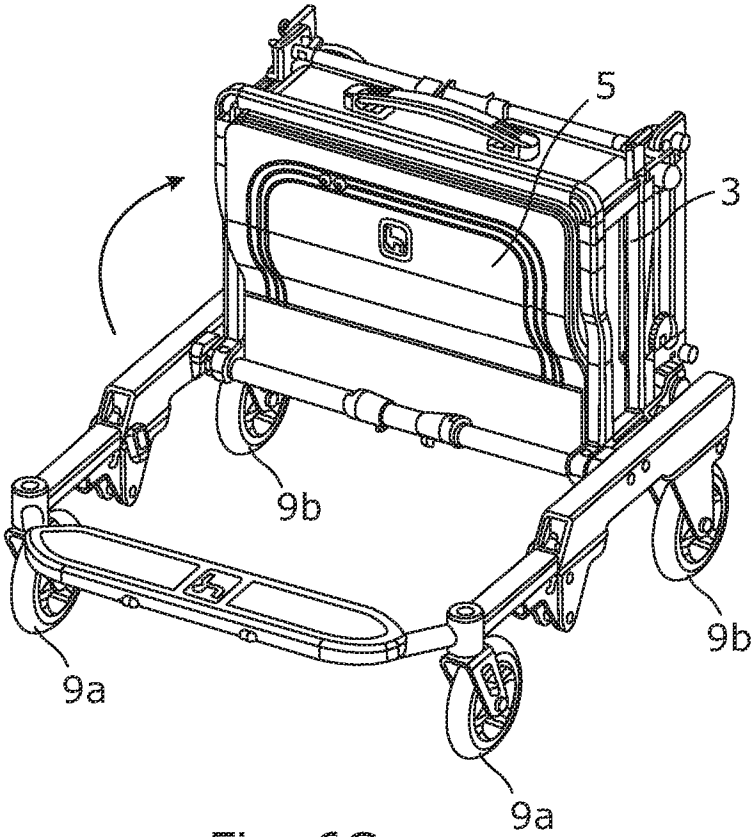

The lower elongate supports 3 are then moved together with the shell 5 into their deployed position so that wheels 9*a*, 9*b* extend beneath the shell 5 and are positionable in contact with the ground, as shown in FIG. 6*c*.

Figure 6E:
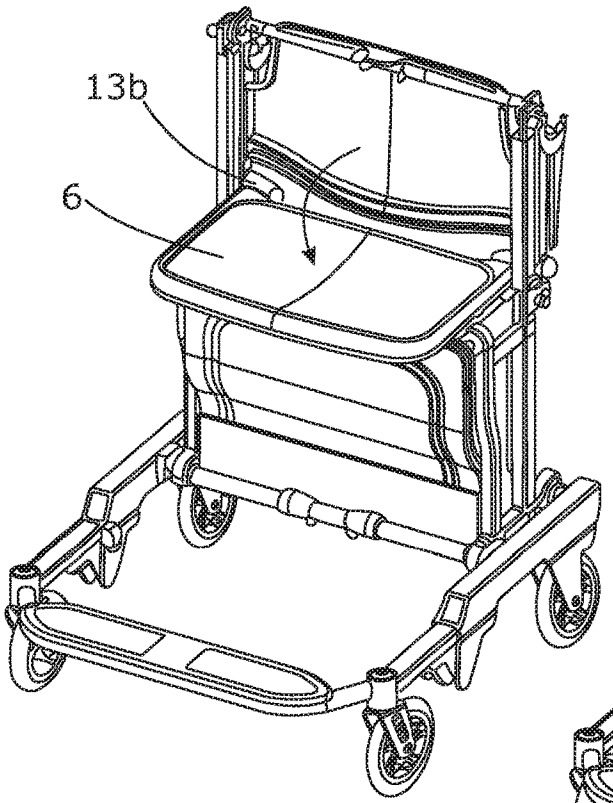

The lower members 4*b* of the upper elongate supports 4 are then unfolded to extend directly away from the lower elongate supports 3 and are locked in place, as shown in FIG. 6*d*. The seat 6 is then rotated around cross member 13*b* onto the upper surface 15*e* of the rigid shell 5, as shown in FIG. 6*e*.

Figure 6F:
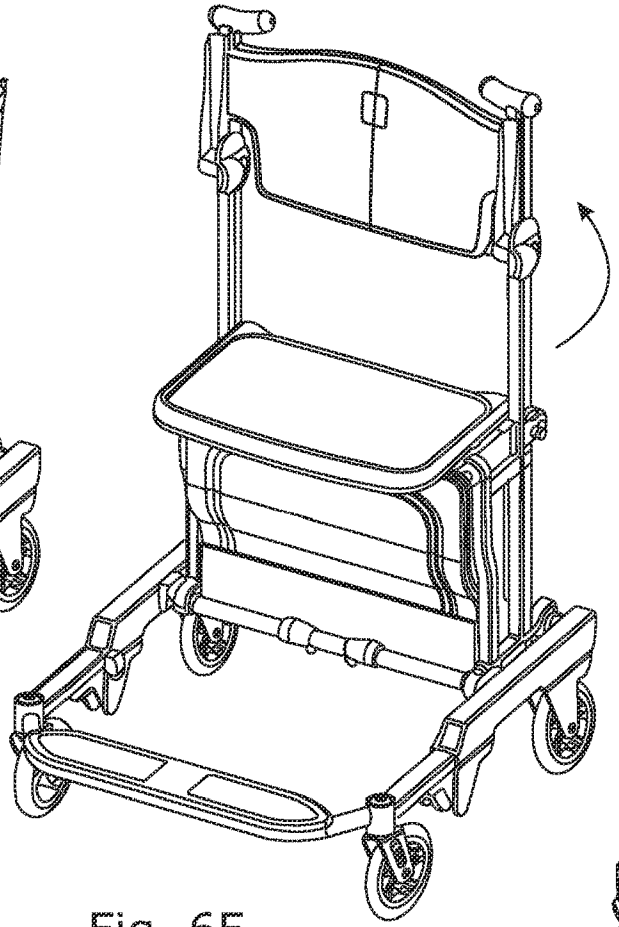

The upper members 4*a* of the upper elongate supports 4 are then moved into the erected position to establish the backrest 7 and position the handles 8, as shown in FIG. 6*f*.

Figure 6G:
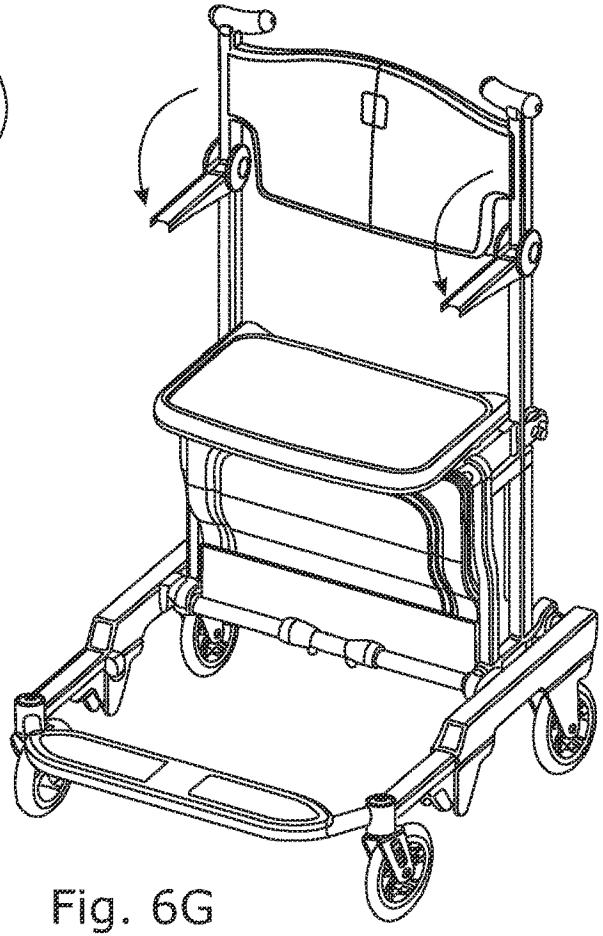

Finally, the armrests 23 are rotated into position to establish the wheelchair configuration, as shown in FIG. 6*g*.

It will be appreciated that various changes and modifications can be made to the embodiments of the invention without departing from the scope of the appended claims.

The invention claimed is:

1. Luggage comprising a rigid shell defining an upper surface to support a person in a seated position thereon, and side surfaces extending from said upper surface, wherein the luggage further comprises a mechanism attached to and surrounding the rigid shell that unfolds so that the rigid shell and the mechanism together form a wheelchair, wherein the mechanism comprises:

a pair of parallel rails fixed to each other in spaced relation, each rail having a front and a rear wheel attached at opposite ends thereof, a pair of lower elongate supports, each lower elongate support having an end mounted to a corresponding rail, each lower elongate support being attached to a corresponding side surface of the rigid shell such that the shell is received between said lower elongate supports, wherein each lower elongate support pivots together with the shell between a stowed position in which each elongate support extends in a direction along the rail to which it is mounted with the shell being received between said parallel rails and with the front and rear wheels depending from each rail positioned alongside a corresponding side surface of said shell, and a deployed position, in which each elongate support extends upwardly from said rail such that the wheels now extend beneath the shell and are positionable in contact with the ground with said upper surface of the shell facing upward to enable a person to sit on said upper surface and be supported by said shell whilst being moved along the ground on said wheels.

2. Luggage according to claim 1, the luggage further comprising a pair of upper elongate supports, an upper elongate support being pivotally mounted to an upper end of a corresponding lower elongate support, and a backrest extending between each upper elongate support, the upper and lower elongate supports being foldable against each other such that the backrest lies against the shell in a stowed position, the upper elongate supports being lockable in an erected position so that a person sitting on the upper support surface can lean on the backrest.

3. Luggage according to claim 2, the luggage further comprising a seat member foldable from a stowed position into a deployed position in which it extends over the upper surface of the shell.

4. Luggage according to claim 3, wherein the upper elongate support is provided with handles for pushing the folding wheelchair.

5. Luggage according to claim 4, wherein the shell is provided with a catch configured to cooperate with a bracket of each rail to secure the shell and pair of lower elongate supports in the deployed position.

6. Luggage according to claim 2, wherein side surfaces of the shell are separated by front and rear major surfaces, the backrest lying against the rear major surface in the stowed position, and wherein an access flap is provided in a front major surface so that a luggage storing interior of the shell can be accessed irrespective of whether the backrest is in the deployed position or the stowed position.

7. Luggage according to claim 2, wherein with the pair of lower elongate supports and the backrest in the stowed positions, the overall dimensions of the luggage do not exceed 60 cm by 50 cm by 30 cm.

8. Luggage according to claim 1, wherein each parallel rail is telescopically extendable to increase the space between front and rear wheels for improved stability.

9. Luggage according to claim 1, wherein each parallel rail is provided with a hinge that divides each parallel rail into first and second members, the first and second members being foldable relative to each other about the hinge between deployed and stowed positions, wherein the front wheels are affixed to ends of the first members and the rear wheels are affixed to ends of the second members, and wherein, when the first and second members are in the deployed position, the first and second members extend directly away from each other either side the hinge to position the front and rear wheels for contact with the ground, and wherein, when the first and second members are in the stowed position, each first member extends in a direction along the second member to which it is hinged so that the front and rear wheels are positioned alongside a corresponding side surface of the rigid shell.

10. Luggage according to claim 9, wherein a footplate extends between ends of the first members of the parallel rails so that the footplate is deployed together with the front wheels when the first and second members are in the deployed position.

11. Luggage according to claim 1, wherein the luggage further comprises a footplate configured to sit flat against the upper surface of the shell when the pair of lower elongate supports is in the stowed position.

* * * * *